US009330582B1

(12) United States Patent
Spinner

(10) Patent No.: US 9,330,582 B1
(45) Date of Patent: May 3, 2016

(54) MOTIVE SIGN APPARATUS

(71) Applicant: Jeffrey Michael Spinner, Ramsey, MN (US)

(72) Inventor: Jeffrey Michael Spinner, Ramsey, MN (US)

( * ) Notice: Subject to any disclaimer, the term of this patent is extended or adjusted under 35 U.S.C. 154(b) by 0 days.

(21) Appl. No.: 14/960,392

(22) Filed: Dec. 6, 2015

(51) Int. Cl.
*G09F 7/22* (2006.01)
*G09F 19/02* (2006.01)

(52) U.S. Cl.
CPC . *G09F 7/22* (2013.01); *G09F 19/02* (2013.01)

(58) Field of Classification Search
CPC .... G09F 7/22; G09F 17/00; G09F 2017/0066
See application file for complete search history.

(56) References Cited

U.S. PATENT DOCUMENTS 902,496 A * 10/1908 Lafond ..... G09F 11/23 40/614
1,413,915 A * 4/1922 Horney ..... G09F 11/23 340/481
1,556,133 A * 10/1925 Stanley ..... G09F 11/23 40/614
1,842,645 A * 1/1932 Apfelbaum ..... G09F 11/34 40/613
2,270,753 A * 1/1942 Fikes ..... G09F 17/00 116/173
2,528,962 A * 11/1950 Lieutard ..... G08G 1/096716 116/63 P
3,213,557 A * 10/1965 Clement ..... G09F 11/23 116/63 P
4,461,234 A * 7/1984 Bounds ..... G09F 17/00 116/173
5,294,138 A * 3/1994 Yang ..... G08G 1/0955 116/63 P
5,450,811 A * 9/1995 Heiland ..... B60Q 7/00 116/173
6,448,905 B1 * 9/2002 Jones ..... G08G 1/0965 116/63 P
2013/0185967 A1 * 7/2013 Adams ..... G09F 7/22 40/218

* cited by examiner

*Primary Examiner* — Gary Hoge
(74) *Attorney, Agent, or Firm* — Dave Alan Lingbeck

(57) ABSTRACT

A motive sign apparatus for broadcasting a sign up and down and back and forth to gain attention. The motive sign apparatus includes a mobile cart having a housing with side walls; an actuator assembly disposed inside the housing and including an actuator; and a sign support assembly in communication with the actuator.

13 Claims, 4 Drawing Sheets

MOTIVE SIGN APPARATUS

BACKGROUND OF THE INVENTION

1. Field of the Invention

The present invention relates to movement signs and more particularly pertains to a new motive sign apparatus for broadcasting a sign up and down and back and forth to gain attention.

2. Description of the Prior Art

The use of movement signs is known in the prior art. More specifically, movement signs heretofore devised and utilized are known to consist basically of familiar, expected and obvious structural configurations, notwithstanding the myriad of designs encompassed by the crowded prior art which have been developed for the fulfillment of countless objectives and requirements.

The prior art includes a sign waving apparatus that includes a base, a housing enclosing a motor, a frame support connecting the base and the housing, and a sign mount mechanically connected to a motor. The sign mount moves relative to the housing in a variety of different motions. Another prior art includes a robotic sign waver having a chassis including a main plate which mounts a drive train. The drive train includes a motor and a gearbox coupled to the motor. The gearbox has an output shaft that drives a crank arm with a linkage rod attached thereto. The linkage rod drives a rocker plate that is mounted on the main plate for repetitive motion. An elongated waving arm is mounted on the rocker plate for repetitive motion with the rocker plate. The rocker plate is robust to withstand the stress and wear of repetitive motion while the waving arm is relatively light to minimize its load on the drive train. Also another prior art includes an orbital sign assembly allowing for attachment to and full pivot or orbit capability of the attached signage around a horizontal run of span wire or other support member. Any one traffic signage is supported from a horizontal run of a span wire or other support member by a orbital sign assembly comprising a sign bracket with attachment points at opposing ends and center, a pivot attachment allowing 360 degree pivoting of the sign, which adjoins the sign bracket to the a cable saddle which contains two pivot attachment rails for limiting side to side movement of the pivot attachment on its track. Conventional U-bolts are located within the cable saddle and are used to clamp down to the span wire while still allowing traffic signal cables to be inserted through a cable slot within the cable saddle. While these devices fulfill their respective, particular objectives and requirements, the aforementioned patents do not disclose a new motive sign apparatus.

SUMMARY OF THE INVENTION

The general purpose of the present invention, which will be described subsequently in greater detail, is to provide a new motive sign apparatus which has many of the advantages of the movement signs mentioned heretofore and many novel features that result in a new motive sign apparatus which is not anticipated, rendered obvious, suggested, or even implied by any of the prior art movement signs, either alone or in any combination thereof. The present invention may include a mobile cart having a housing with side walls; an actuator assembly disposed inside the housing and including an actuator; and a sign support assembly in communication with the actuator. None of the prior art includes the combination of the elements of the present invention.

There has thus been outlined, rather broadly, the more important features of the motive sign apparatus in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new motive sign apparatus which has many of the advantages of the movement signs mentioned heretofore and many novel features that result in a new motive sign apparatus which is not anticipated, rendered obvious, suggested, or even implied by any of the prior art movement signs, either alone or in any combination thereof.

Still another object of the present invention is to provide a new motive sign apparatus for broadcasting a sign up and down and back and forth to gain attention.

Still yet another object of the present invention is to provide a new motive sign apparatus that stabilizes the shaft as the sign is put into motion.

Even still another object of the present invention is to provide a new motive sign apparatus that safeguards and prevents damage to the sign from the environment or if somebody bumps into the apparatus.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
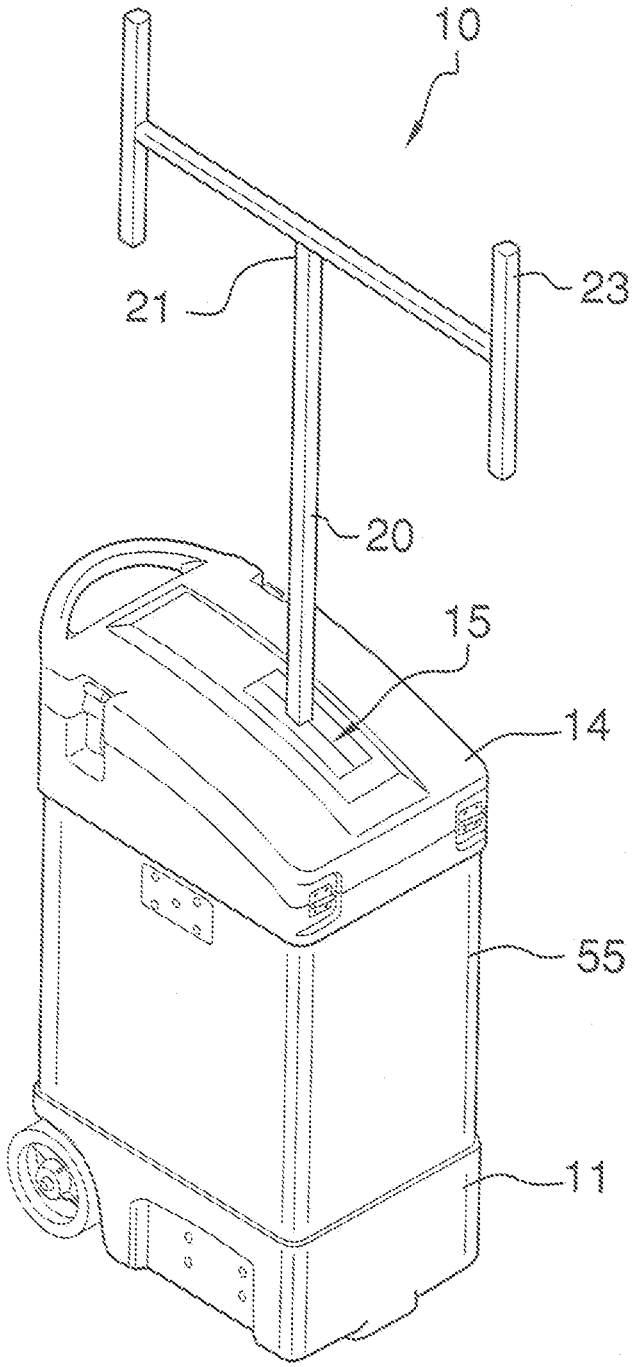
FIG. 1 is a top perspective view of a new motive sign apparatus according to the present invention.
Figure 2:
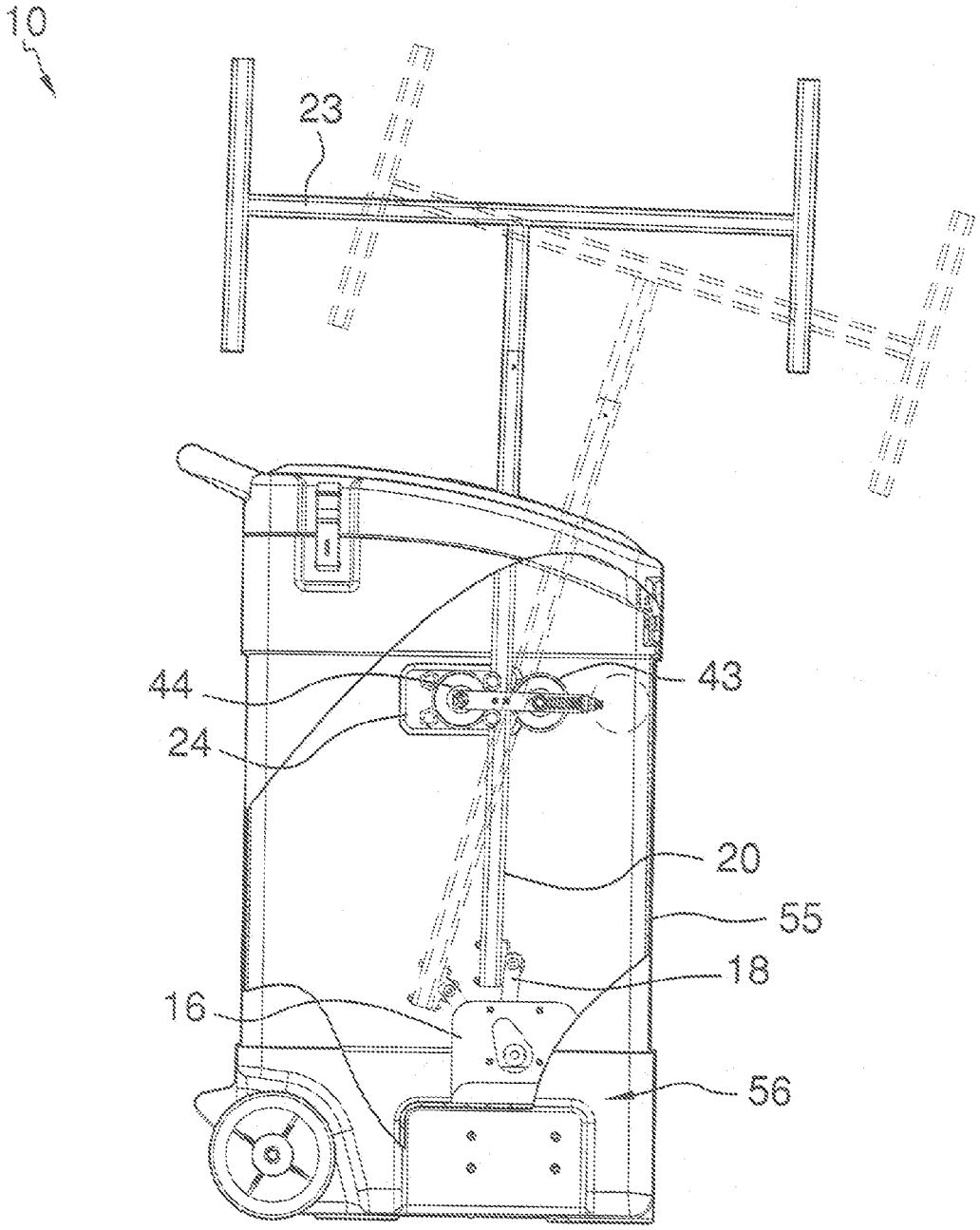
FIG. 2 is a cutaway side elevation view of the present invention.
Figure 3:
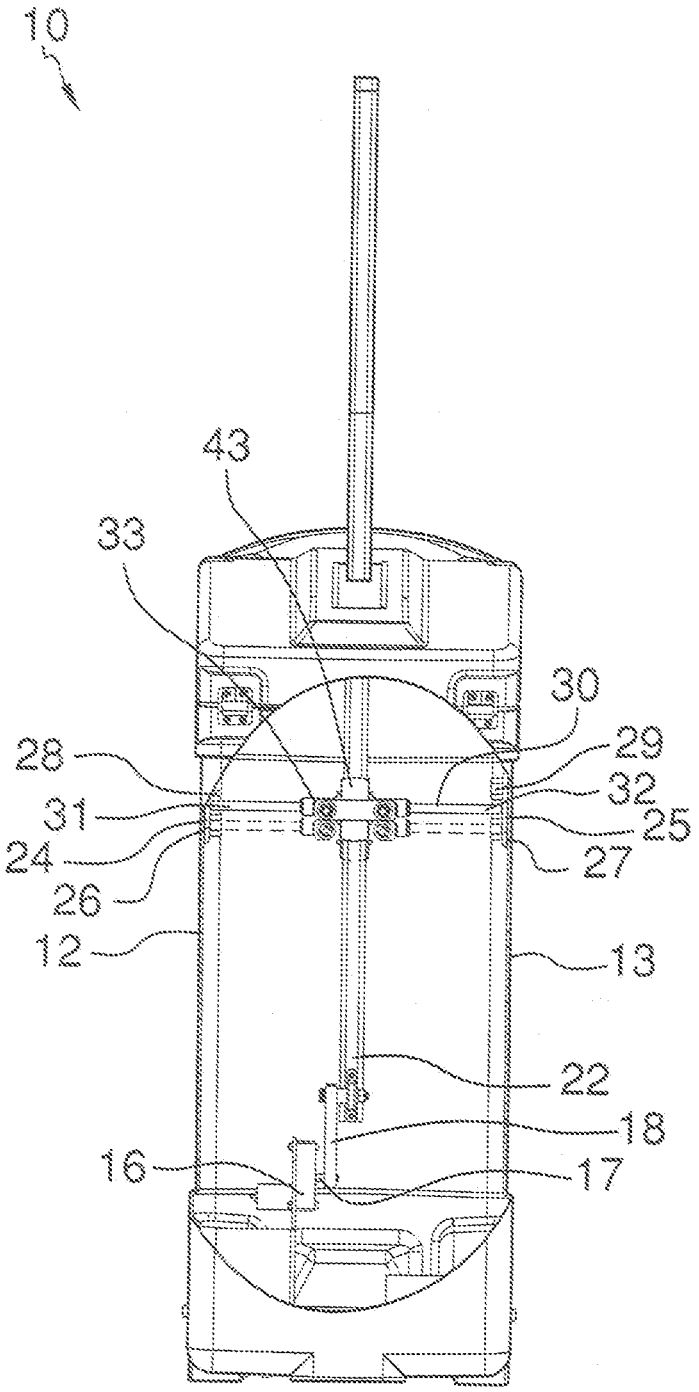
FIG. 3 is a cutaway end elevation view of the present invention.

With reference now to the drawings, and in particular to FIGS. 1 through 4 thereof, a new motive sign apparatus embodying the principles and concepts of the present invention and generally designated by the reference numeral 10 will be described.

As best illustrated in FIGS. 1 through 4, the motive sign apparatus 10 may generally comprise a mobile cart 11 movable upon a ground and having a housing 55 with side walls 12, 13 and also including a cover 14 conventionally disposed upon the housing 55 and having an elongate slot 15 disposed therethrough. The motive sign apparatus 10 may also comprise an actuator assembly 56 conventionally disposed inside the housing such as resting upon a bottom of the housing 55 and the actuator assembly 56 may also include an actuator 16. The sign motive cart 10 may further comprise a sign support assembly 19 in communication with the actuator 16.

As shown in FIGS. 1 through 4, the sign support assembly 19 may include a shaft 20 in communication with the actuator 16 and extending upwardly and outwardly from the housing 55 through the elongate slot 15 of the cover 14 and having a top end 21 exposed above the housing 55. The actuator 16 when activated or energized moves the shaft 20 relative to the housing 55. The sign support assembly 19 may also include a sign frame 23 conventionally attached and welded to the top end 21 of the shaft 20 for movement therewith. The sign support assembly 19 may further include mounting brackets 24, 25 opposedly and conventionally attached with fasteners or welded inside the housing 55 to the side walls 12, 13, and may also include an elongate support member 30 adjustably mounted to the mounting brackets 24, 25 and traversing inside the housing 55. Each of the mounting brackets 24, 25 may include a base 26, 27 and mounts 28, 29 spaced apart and integrally attached to and extending outwardly from and perpendicular to the base 26, 27. The elongate support member 30 may have ends 31, 32 which are adjustably and conventionally supported upon and engagable with one or more of the mounts 28, 29 of each of the mounting brackets 24, 25. The elongate support member 30 may be vertically adjustable inside the housing 55.

Figure 4:
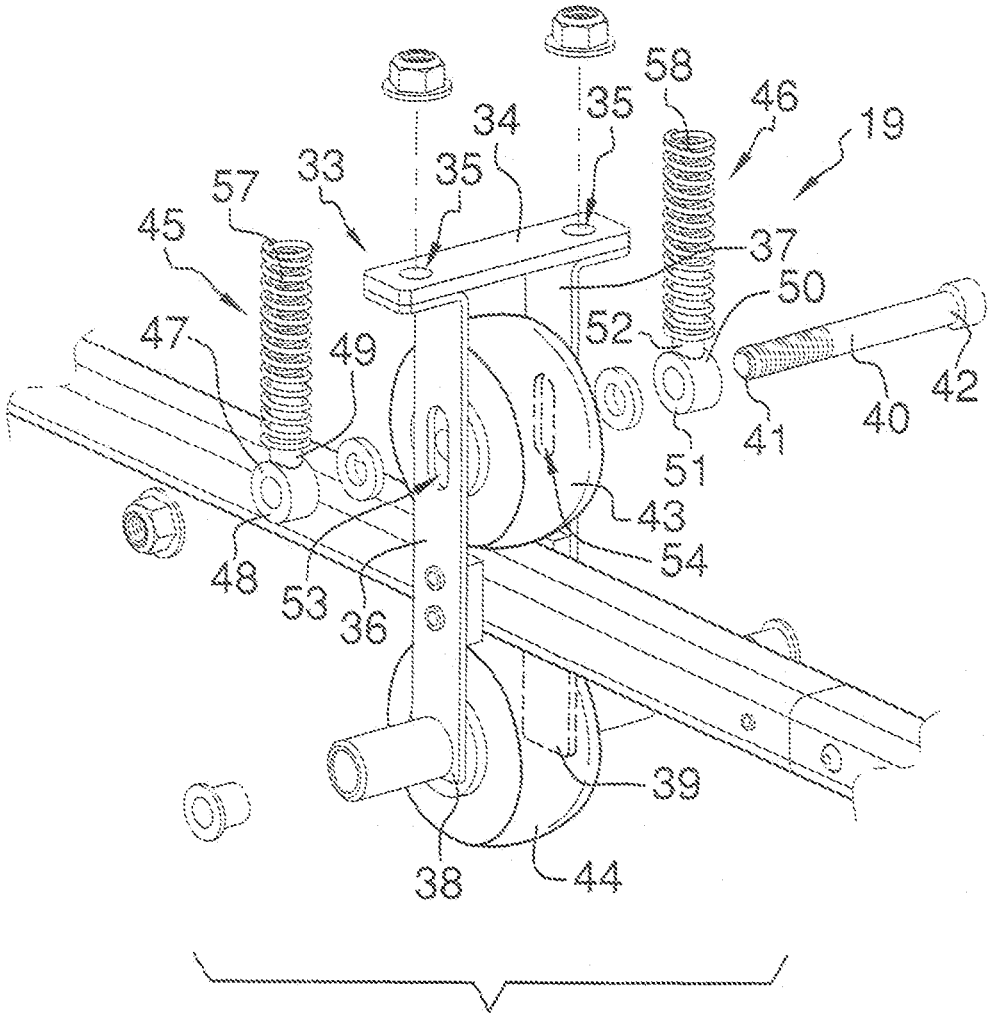
FIG. 4 is a perspective view of the shaft support assembly of the present invention.

As specifically shown in FIG. 4, the sign support assembly 19 may also include a bracket member 33 conventionally mounted to the elongate support member 30 for guiding the shaft 20. The bracket member 33 may include an anchor portion 34 and first and second arm portions 36, 37 conventionally attached to and extending from the anchor portion 34. The first and second arm portions 36, 37 may be spaced apart and disposed parallel to one another with the shaft 20 movably disposed between the first and second arm portions 36, 37. The sign support assembly 19 may further include an axle 40 movably mounted to the first and second arm portions 36, 37 and may also include a biased first guide member 43 conventionally and rotatably mounted to the axle 40 and movably disposed between the first and second arm portions 36, 37 and engagable with the shaft 20. The sign support assembly 19 may also include a second guide member 44 conventionally rotatably mounted to the elongate support member 30 and engagable with the shaft 20. The elongate support member 30 may be movably disposed between and engagable with the first and second guide members 43, 44. The first and second guide members 43, 44 may be wheels. The sign support assembly 19 may further include biased members 45, 46 each conventionally coupled with fastening members to the anchor portion 34 and disposed adjacent and parallel to a respective one of the first and second arm portions 36, 37 and conventionally coupled to the axle 40. Each of the biased members 45, 46 may include a spring support member 47, 50 and a spring 57, 58 conventionally disposed upon the spring support member 47, 50. The spring support member 47, 50 of each of the biased members 45, 46 may include a grommet 48, 51 and a linkage portion 49, 52 conventionally attached to and extending from the grommet 48, 51. The grommet 48, 51 may be conventionally coupled to the axle 40 and the linkage portion 49, 52 may be conventionally fastened with bolts to the anchor portion 34. The first and second arm portions 36, 37 each may have a longitudinal-extending slot 53, 54 disposed therethrough. The axle 40 may have ends 41, 42 which are movably disposed in the longitudinal-extending slots 53, 54. The first guide member 43 may move relative to the first and second arm portions 36, 37 and may be always biasedly engaged with and roll upon the shaft 20 upon actuation of the shaft 20. Each of the first and second arm portions 36, 37 has a distal end 38, 39. The elongate support member 30 may be conventionally disposed through the first and second arm portions 36, 37 near the distal ends 38, 39 thereof.

The actuator assembly 56 may also include a rotatable shaft member 17 conventionally connected to the actuator 16, and may further include a linkage member 18 conventionally connected to the rotatable shaft member 17. The shaft 20 may have a bottom end 22 which may be rotatably and conventionally coupled to the linkage member 18.

In use, the actuator is activated or energized with a conventional power source and moves the shaft 20 back and forth and vertically relative to the mobile cart 11. The shaft 20 may be stabilized and supported by the biased first guide member 43 moving with and rolling upon and always engaging the shaft 20 and by the second guide member 44 which is positioned about the elongate support member 30 and which also always rollably engages and moves upon the shaft as the shaft moves.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the motive sign apparatus. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sign motive apparatus comprising:

a mobile cart having a housing with side walls and movable upon a ground;

an actuator assembly disposed inside the housing and including an actuator; and a sign support assembly in communication with the actuator, wherein the sign support assembly includes a shaft in communication with the actuator and extending upwardly and outwardly from the housing, wherein the actuator when activated moves the shaft relative to the housing, wherein the sign support assembly further includes mounting brackets opposedly attached inside the housing to the side walls, and also includes an elongate support member adjustably mounted to the mounting brackets and traversing inside the housing.

2. The sign motive apparatus as described in claim 1, wherein each of the mounting brackets includes a base with mounts spaced apart and extending outwardly from and perpendicular to the base, wherein the elongate support member has ends which are adjustably supported upon and engagable with one or more of the mounts of each of the mounting brackets.

3. The sign motive apparatus as described in claim 1, wherein the elongate support member is vertically adjustable inside the housing.

4. The sign motive apparatus as described in claim 1, wherein the sign support assembly also includes a bracket member mounted to the elongate support member for guiding the shaft.

5. The sign motive apparatus as described in claim 4, wherein the bracket member includes an anchor portion and first and second arm portions extending from the anchor portion, wherein the first and second arm portions are spaced apart and parallel to each other with the shaft movably disposed between the first and second arm portions.

6. The sign motive apparatus as described in claim 5, wherein the sign support assembly further includes an axle movably mounted to the first and second arm portions and also includes a biased first guide member rotatably mounted to the axle and movably disposed between the first and second arm portions and rollably engagable upon the shaft.

7. The sign motive apparatus as described in claim 6, wherein the sign support assembly also includes a second guide member rotatably mounted to the elongate support member and rollably engagable upon the shaft, wherein the elongate support shaft is movably disposed between and engagable with the first and second guide members, wherein the first and second guide members are wheels.

8. The sign motive apparatus as described in claim 6, wherein the sign support assembly further includes biased members each coupled to the anchor portion and disposed adjacent to a respective one of the first and second arm portions and coupled to the axle.

9. The sign motive apparatus as described in claim 8, wherein each of the biased members includes a spring support member and a spring disposed upon the spring support member.

10. The sign motive apparatus as described in claim 9, wherein the spring support member of each of the biased members includes a grommet and a linkage portion extending outwardly from the grommet, wherein the grommet is coupled to the axle and the linkage portion is fastened to the anchor portion.

11. The sign motive apparatus as described in claim 6, wherein the first and second arm portions each has a longitudinal-extending slot disposed therethrough, wherein the axle has ends which are movably disposed in the longitudinal-extending slots.

12. The sign motive apparatus as described in claim 11, wherein the first guide member moves relative to the first and second arm portions and is always biasedly and rollably engaged upon the shaft upon actuation of the shaft.

13. The sign motive apparatus as described in claim 5, wherein each of the first and second arm portions has a distal end, wherein the elongate support member is disposed through the first and second arm portions near the distal ends thereof.

* * * * *